US009597910B2

(12) United States Patent
Mitsui et al.

(10) Patent No.: US 9,597,910 B2
(45) Date of Patent: Mar. 21, 2017

(54) TONER FOR THERMAL TRANSFER PRINTING SHEET, THERMAL TRANSFER PRINTING SHEET, AND PRODUCTION METHOD THEREOF

(71) Applicant: CASIO COMPUTER CO., LTD., Shibuya-ku, Tokyo (JP)

(72) Inventors: Satoshi Mitsui, Tokyo (JP); Masaru Sato, Kodaira (JP); Hideyoshi Niinuma, Hanno (JP); Tomohumi Sano, Iruma (JP); Toshiaki Kanamura, Ome (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/937,575

(22) Filed: Nov. 10, 2015

(65) Prior Publication Data

US 2016/0176214 A1 Jun. 23, 2016

(30) Foreign Application Priority Data

Dec. 22, 2014 (JP) ..... 2014-258563

(51) Int. Cl.

| | |
|---|---|
| ***B41M 5/025*** | (2006.01) |
| ***B41M 5/382*** | (2006.01) |
| ***B41M 5/385*** | (2006.01) |
| ***B41M 5/44*** | (2006.01) |

(52) U.S. Cl.

CPC ..... *B41M 5/385* (2013.01); *B41M 5/0256* (2013.01); *B41M 5/38257* (2013.01); *B41M 5/44* (2013.01); *B41M 5/38214* (2013.01); *B41M 2205/06* (2013.01); *B41M 2205/10* (2013.01)

(58) Field of Classification Search

CPC .... B41M 5/025; B41M 5/0256; B41M 5/382; B41M 5/38214; B41M 5/38257; B41M 5/385; B41M 2205/06; B41M 2205/10

USPC ..... 428/32.72, 32.79, 402; 399/130, 139

See application file for complete search history.

(56) References Cited

U.S. PATENT DOCUMENTS

| | | | |
|---|---|---|---|
| 2009/0011356 | A1 | 1/2009 | Tomita et al. |
| 2013/0078009 | A1 | 3/2013 | Sano et al. |
| 2014/0286674 | A1 | 9/2014 | Mitsui et al. |

FOREIGN PATENT DOCUMENTS

| | | | |
|---|---|---|---|
| JP | 11231565 | A | 8/1999 |
| JP | 2007279653 | A | 10/2007 |
| JP | 2010152234 | A | 7/2010 |
| JP | 2010191148 | A | 9/2010 |
| JP | 2013068862 | A | 4/2013 |
| JP | 2014059486 | A | 4/2014 |
| JP | 2014186151 | A | 10/2014 |

OTHER PUBLICATIONS

Japanese Office Action (and English translation thereof) dated Nov. 1, 2016, issued in counterpart Japanese Application No. 2014-258563.

*Primary Examiner* — Bruce H Hess

(74) *Attorney, Agent, or Firm* — Holtz, Holtz & Volek PC

(57) ABSTRACT

A toner for a thermal transfer printing sheet is advantageous in terms of a fixing property to a release sheet, durability against deformation upon cooling, and a property of holding an image-forming toner, in addition to grindability and chargeability of the toner. The toner for a thermal transfer printing sheet is characterized by comprising a negative-charged crystalline polyester resin, wherein the toner has an average particle size D50 (volume) of 20 to 50 μm.

3 Claims, 3 Drawing Sheets

TONER FOR THERMAL TRANSFER PRINTING SHEET, THERMAL TRANSFER PRINTING SHEET, AND PRODUCTION METHOD THEREOF

CROSS-REFERENCE TO RELATED APPLICATIONS

This application is based upon and claims the benefit of priority from Japanese Patent Application No. 2014-258563, filed Dec. 22, 2014, the entire contents of which are incorporated herein by reference.

BACKGROUND OF THE INVENTION

1. Field of the Invention

The present invention relates to toner for a thermal transfer printing sheet and a production method thereof, and a thermal transfer printing sheet obtained by using the toner and a production method thereof.

2. Description of the Related Art

Transfer to various materials including metals, wood and resins, in addition to a cloth, can be performed by a thermal transfer printing technique using a thermal transfer printing sheet. Jpn. Pat. Appln. KOKAI Publication No. 2013-68862 discloses a thermal transfer printing sheet comprising a release sheet, a printed image formed on the release sheet, and a film-shaped toner layer made of a thermoplastic resin and formed on the release sheet so as to correspond to the printed image. The thermal transfer printing sheet is superimposed on a transfer object, and they are heated and pressurized, thereby thermally transferring the printed image and the film-shaped toner layer to the transfer object. In the instant specification, a toner which forms a printed image in a thermal transfer printing sheet may also be referred to as an "image-forming toner", and a toner which forms a film-shaped toner layer in a thermal transfer printing sheet may also be referred to as "film-forming toner."

As for the toner usually used for forming letters or images, high image quality printing is realized by decreasing a diameter of toner particles. On the other hand, it is required for the film-forming toner to have characteristics necessary for film formation such as a fixing property to a release sheet, a property of holding an image-forming toner, and an adhesive property to a transfer object, in addition to characteristics required for the usual toners such as grindability and chargeability. When the transfer object is a cloth, characteristics including a following property to a shrunk cloth, a launderability, and the like are also necessary.

BRIEF SUMMARY OF THE INVENTION

A toner for a thermal transfer printing sheet according to a first aspect of the present invention comprises a negative-charged crystalline polyester resin, wherein the toner has an average particle size D50 (volume) of 20 to 50 μm.

A method for producing a toner for a thermal transfer printing sheet according to a second aspect of the present invention comprises: freeze-pulverizing a raw material containing a negative-charged crystalline polyester resin, wherein the raw material is freeze-pulverized so that a pulverized product has an average particle size D50 (volume) of 20 to 50 μm.

A thermal transfer printing sheet according to a third aspect of the present invention comprises: a release sheet having a release surface; and a film pattern releasably supported on the release surface, wherein the film pattern comprises (i) a color toner layer which forms a printed image, and (ii) a film-shaped toner layer which is formed from a toner containing a negative-charged crystalline polyester resin and having an average particle size D50 (volume) of 20 to 50 μm, wherein the film-shaped toner layer is at least partially overlapped with the printed image.

A method for producing a thermal transfer printing sheet according to a fourth aspect of the present invention comprises: forming a film pattern releasably supported on a release surface of a release sheet, wherein the film pattern comprises (i) a color toner layer which forms a printed image, and (ii) a film-shaped toner layer which is formed from a toner containing a negative-charged crystalline polyester resin and having an average particle size D50 (volume) of 20 to 50 μm, wherein the film-shaped toner layer is at least partially overlapped with the printed image; and fixing the film pattern by heat and pressure into a film.

BRIEF DESCRIPTION OF THE SEVERAL VIEWS OF THE DRAWING

The present invention will be more understood with reference to the following detailed descriptions in combination with the accompanying drawings.

DETAILED DESCRIPTION OF THE INVENTION

Figure 1:
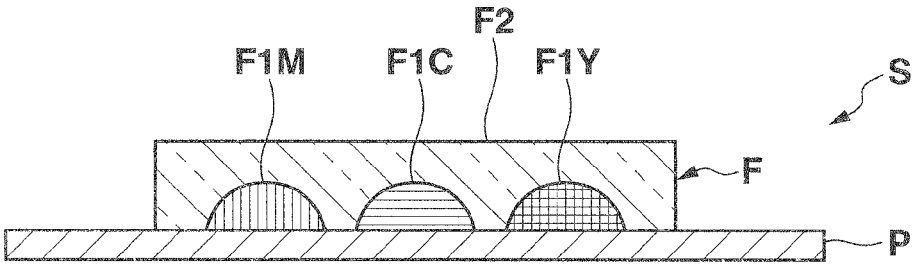
FIG. 1 is a cross-sectional view schematically showing a thermal transfer printing sheet according to one embodiment of the present invention.

Embodiments of the present invention are explained below.

The present inventors have found that when a negative-charged crystalline polyester resin is used as a main resin of a film-forming toner in the production of a thermal transfer printing sheet, a fixing property to a release sheet, durability against deformation upon cooling, and a property of holding an image-forming toner, in addition to grindability and chargeability of the toner, are improved; and have completed the present invention.

1. Toner for Thermal Transfer Printing Sheet

The toner for a thermal transfer printing sheet according to an embodiment of the present invention contains a negative-charged crystalline polyester resin, wherein the toner has an average particle size D50 (volume) of 20 to 50 μm.

In the present embodiment, the crystalline polyester resin refers to a polyester resin in which an exothermic peak is observed on a DSC (differential scanning calorimetry) curve obtained by a differential scanning calorimetry according to a known method.

In the present embodiment, the negative-charged crystalline polyester resin has a film-forming capability. Such a crystalline polyester resin has typically a low grass transition temperature (Tg), preferably a Tg of 10° C. or lower.

As the negative-charged crystalline polyester resin, for example, VYLON "GM-990" (TOYOBO Co., Ltd.), POLYESTER "SP154" (Nippon Synthetic Chemical Industry Co., Ltd.), POLYESTER "SP176" (Nippon Synthetic Chemical Industry Co., Ltd.), "PES-120L" (TOAGOSEI Co., Ltd.), Elitel "UE3200G" (UNITIKA Ltd.) and the like may be used.

The toner according to the present embodiment has an average particle size D50 (volume) of 20 to 50 μm, preferably 25 to 40 μm. Here, the average particle size refers to a value obtained by a flow type image analysis method. When the average particle size is too small, it is difficult to obtain a film having a sufficient thickness. When the average particle size is too large, a sufficient development amount may not be obtained because of lack of a charge amount. The toner according to the present embodiment has a defined average particle size, and thus the toner is suitable for the film formation. Even if a coloring agent is added to the toner and letters or images are printed, it is difficult to print them with a high image quality.

The toner according to the present embodiment may contain, in addition of the negative-charged crystalline polyester resin, additives such as a charge control agent and a release agent.

The toner according to the present embodiment contains preferably fluororesin fine particles as the charge control agent. It is necessary for the fluororesin fine particles to have a heat-resistance capable of withstanding a heating temperature upon heat-fixing or heat-transferring, and the particles has preferably heat-resistance of 200° C. or higher, more preferably a heat-resistance of 200 to 400° C. The fluororesin fine particle has a primary particle size of preferably 1 μm or less, more preferably 300 to 800 nm.

The fluororesin fine particle may include polytetrafluoroethylene, polychlorotrifluoroethylene, polyvinylidene fluoride, polyvinyl fluoride, perfluoroalkoxy fluororesin, tetrafluoroethylene-hexafluoropropylene copolymer, ethylene-tetrafluoroethylene copolymer, ethylene-chlorotrifluoroethylene copolymer, and the like. As the fluororesin fine particles, for example, polytetrafluoroethylene "KTL-500F" (KITAMURA Limited), "KTL-8F" (KITAMURA Limited), "KTL-8FH" (KITAMURA Limited) and the like may be used.

The fluororesin fine particles can be contained in the toner in an amount of generally 0.1 to 10 parts by mass, based on 100 parts by mass of the crystalline polyester resin, preferably 1 to 7 parts by mass, based on 100 parts by mass of the crystalline polyester resin. When the fluororesin fine particles are added to the film-forming toner, a strength against rubbing and a fogging property of the toner can be improved, as demonstrated in Examples described below.

When the toner according to the present embodiment contains the fluororesin fine particles, it is possible to finely control the chargeability by further containing a charge control agent other than the fluororesin fine particles.

The toner according to the present embodiment contains preferably a Fischer-Tropsch wax as the release agent. The Fischer-Tropsch wax refers to a synthetic hydrocarbon wax which is produced according to a Fischer-Tropsch process using carbon monooxide and hydrogen as raw materials.

As the Fischer-Tropsch wax, for example, "FNP-0090" (NIPPON SEIRO Co., Ltd.), "SX-105" (NIPPON SEIRO Co., Ltd.), "H1N4" (Sasol Wax GmbH), and the like may be used.

The Fischer-Tropsch wax may be contained in the toner in an amount of generally 1 to 6 parts by mass, based on 100 parts by mass of the crystalline polyester resin, preferably 2 to 4 parts by mass, based on 100 parts by mass of the crystalline polyester resin. When the Fischer-Tropsch wax is added to the film-forming toner, a kneading property and a low-temperature fixing effect of the toner can be improved, as demonstrated in Examples described below.

The toner of the present embodiment can form a colored film by containing a coloring agent. For example, in a case where a deep color background, such as blue or black, is used as the transfer object of the thermal transfer printing sheet, it is possible to form a white film by containing a white coloring agent such as titanium oxide, talc, kaolin, zinc sulfide, barium sulfate, calcium carbonate or zinc oxide in the toner of the present embodiment.

2. Production Method of Toner for Thermal Transfer Printing Sheet

The toner according to the present embodiment can be produced by melt-kneading a toner raw material containing the negative-charged crystalline polyester resin and necessary additives (for example, the above-mentioned fluororesin fine particles, the above-mentioned Fischer-Tropsch wax, and the like), and freeze-pulverizing the obtained melt-kneaded product. The freeze-pulverization step is performed so that the pulverized product has an average particle size D50 (volume) of 20 to 50 μm.

The melt-kneading can be performed using a pressure kneader or a twin-screw extruder. The melt-kneaded product may be, prior to the freeze-pulverization, passed through a strand die, cooled, and then it may be pelletized through a pelletizer. Alternatively, the melt-kneaded product may be, prior to the freeze-pulverization, cooled with liquid nitrogen and then roughly pulverized through Rotoplex, or the like.

The freeze-pulverization can be performed by immersing the melt-kneaded product in liquid nitrogen and pulverizing the resulting product, which has been sufficiently cooled, with a coffee mill or a small size blender. Alternately, the freeze-pulverization can also be performed using Linrex Mill "LX-0" (Hosokawa Micron Corporation) as the freeze-pulverizing machine. It is preferable that the freeze-pulverization is performed at a temperature equal to or lower than Tg of the negative-charged polyester resin, for example, at a temperature of −50° C. or lower.

After the freeze-pulverization, the resulting product is classified to obtain toner particles, which may be used as the film-forming toner. Alternatively, after the freeze-pulverization, the resulting product is classified to obtain toner particles, and external additives are added thereto according to a known method, which may be used as the film-forming toner.

3. Thermal Transfer Printing Sheet

A thermal transfer printing sheet can be produced using the toner according to the present embodiment. The thermal transfer printing sheet according to an embodiment of the present invention comprises:

a release sheet having a release surface; and a film pattern releasably supported on the release surface, wherein the film pattern comprises (i) a color toner layer which forms a printed image, and (ii) a film-shaped toner layer which is formed from a toner containing a negative-charged crystalline polyester resin and having an average particle size D50 (volume) of 20 to 50 μm, wherein the film-shaped toner layer is at least partially overlapped with the printed image.

Figure 2:
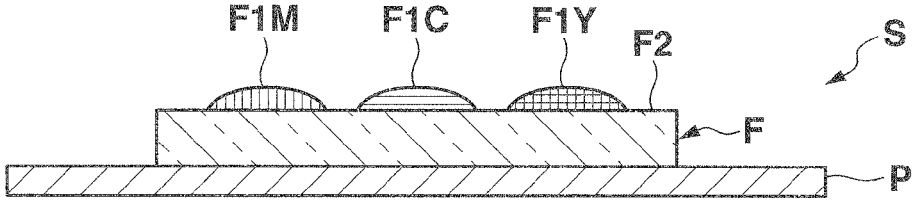
FIG. 2 is a cross-sectional view schematically showing a thermal transfer printing sheet according to another embodiment of the present invention.

Examples of the thermal transfer printing sheet according to the present embodiment are shown in FIG. 1 and FIG. 2.

A thermal transfer printing sheet S shown in FIG. 1 comprises a release sheet P having a release surface, and a heat transfer film F releasably supported on the release surface. The heat transfer film F is formed of printed images (F1M, F1C, and F1Y) formed on the release surface of the release sheet P using toner, and a film-shaped toner layer F2 formed using the toner according to the present embodiment so that all of the printed images (F1M, F1C, and F1Y) are covered as a whole.

Similarly to FIG. 1, a thermal transfer printing sheet S shown in FIG. 2 comprises a release sheet P having a release surface, and a heat transfer film F releasably supported on the release surface. The heat transfer film F is formed of a film-shaped toner layer F2 formed on the release surface of the release sheet P using the toner according to the present embodiment, and printed images (F1M, F1C, and F1Y) formed on the toner layer F2 using toner.

In FIGS. 1 and 2, F1M shows a printed image using magenta, F1C shows a printed image using cyan, and F1Y is a printed image using yellow. In FIGS. 1 and 2, the film-shaped toner layer F2 is not colored, and formed of a transparent film toner.

As described above, in the thermal transfer printing sheet S shown in FIG. 1, the printed images (F1M, F1C, and F1Y) are formed so as to be brought into contact with the release sheet P. In the case where a surface of the heat transfer film F on the side of the release sheet P is utilized as a display surface, the printed images (F1M, F1C, and F1Y) are formed so as to be reversed images when the images are observed from a surface of the heat transfer film F opposite from the side of the release sheet P. In this case, the film-shaped toner layer F2 may be opaque. On the other hand, in the case where a surface of the heat transfer film F opposite from the side of the release sheet P is utilized as the display surface, the printed images (F1M, F1C, and F1Y) are formed so as to be normal images when the images are observed from the above-mentioned surface of the heat transfer film F.

In the thermal transfer printing sheet S shown in FIG. 2, a film-shaped toner layer F2 is disposed between printed images (F1M, F1C, and F1Y) and a release sheet P. In the case where a surface of the heat transfer film F on the side of the release sheet P is utilized as a display surface, the printed images (F1M, F1C, and F1Y) are formed so as to be reversed images when the images are observed from a surface of the heat transfer film F opposite from the side of the release sheet P. On the other hand, in the case where a surface of the heat transfer film F opposite from the side of the release sheet P is utilized as the display surface, the printed images (F1M, F1C, and F1Y) are formed so as to be normal images when the images are observed from the above-mentioned surface of the heat transfer film F. In this case, the film-shaped toner layer F2 may be opaque.

A sheet having a low surface energy and a good releasability is used as the release sheet P, and it is possible to use a sheet, such as paper or a film, which can be generally used as a release sheet. The release sheet P can be used repeatedly, and a film-type release sheet is typically used.

When the film-type release sheet is used, high smoothness can be more easily obtained at an interface between the sheet and the heat transfer film after fixing, as compared to a case where a paper-type release sheet is used. In addition, the film-type release sheet can stand a higher number of repeated usages, because of its higher durability, than the paper-type release sheet.

4. Apparatus for Producing Thermal Transfer Printing Sheet

Figure 3:
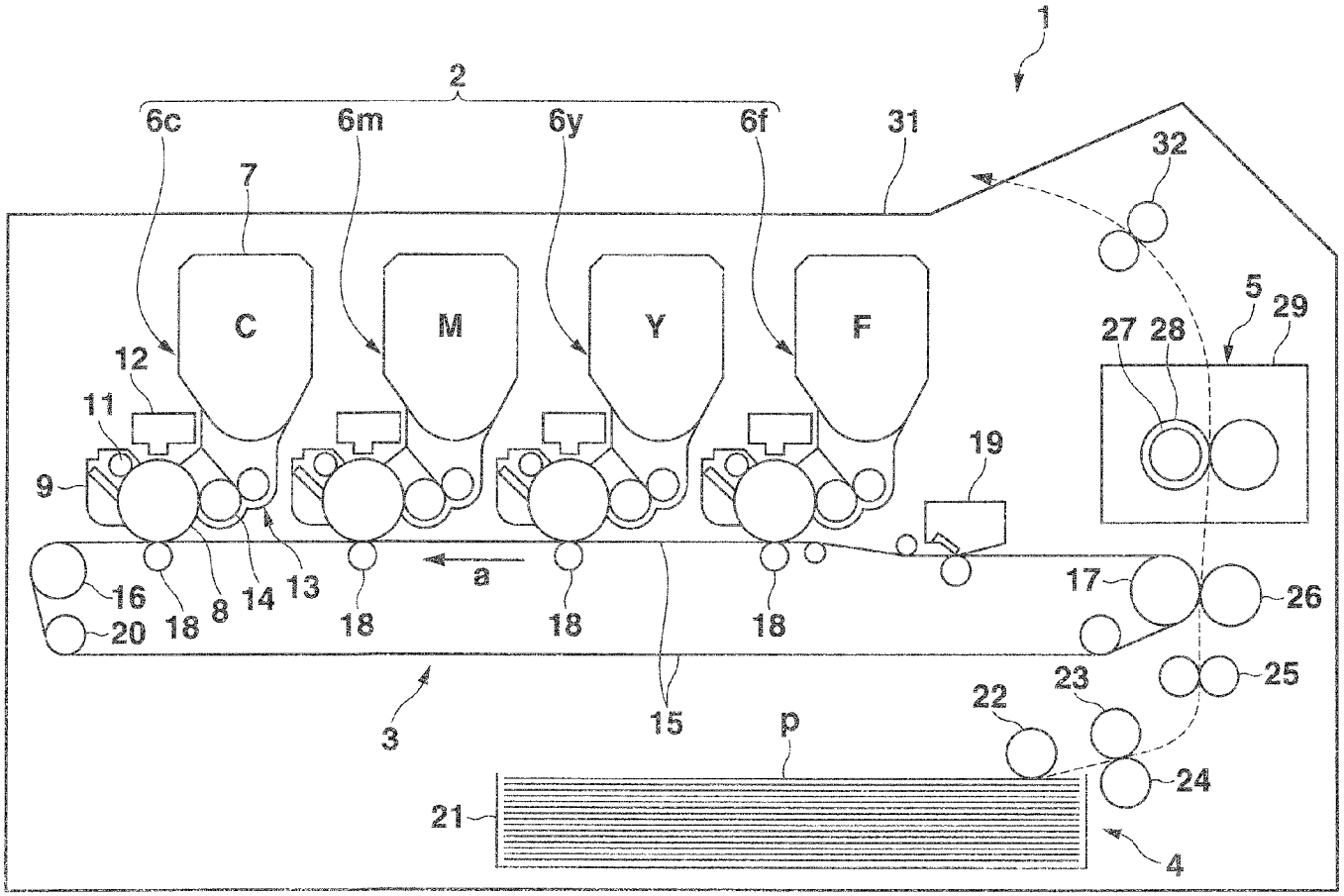
FIG. 3 is a schematic view showing an internal structure of an apparatus for producing a thermal transfer printing sheet according to one embodiment of the present invention.

The thermal transfer printing sheet of the present embodiment can be produced using an apparatus for producing a thermal transfer printing sheet shown in FIG. 3.

FIG. 3 shows an internal structure of an apparatus for producing the thermal transfer printing sheet of the present embodiment. The apparatus 1 for producing a thermal transfer printing sheet shown in FIG. 3 is an electrophotographic, secondary transfer-type, tandem type color image forming apparatus. The apparatus is configured of an image forming section 2, an intermediate transfer belt unit 3, a release sheet-feeding section 4, and a fixing section 5.

The image forming section 2 has a structure in which one film forming unit 6*f* and three image forming units 6*y*, 6*m* and 6*c* are disposed in a multistage manner in parallel from right to left in the drawing.

The film forming unit 6*f* positioned on the upstream side (the right side of the drawing) forms a film-shaped toner layer with a film-forming toner. Each of the three image forming units 6*y*, 6*m* and 6*c* positioned on the downstream side (the left side of the drawing) forms a monochrome color image with color toners of yellow (Y), magenta (M), and cyan (C), respectively.

The film forming unit 6*f*, and the image forming units 6*y*, 6*m* and 6*c* have the same structure except for the kind of the toner contained in a toner container (a toner cartridge) 7. Accordingly, a structure of the film forming unit 6*f* is explained as an example below.

The film forming unit 6*f* includes a photoreceptor drum 8 at the lowermost part. A circumferential surface of the photoreceptor drum 8 is formed of, for example, an organic photoconductive material. A cleaner 9, a charging roller 11, an optical writing head 12, and a developing roller 14 of a developing device 13 are disposed in the vicinity of the circumferential surface of the photoreceptor drum 8.

The developing device 13 contains either of a film-forming toner (F), a yellow toner (Y), a magenta toner (M), and a cyan toner (C), which are shown as F, Y, M, and C in the drawing, respectively, in the toner container 7 located at the upper part of the device. The developing device 13 includes a mechanism to feed the toner to the lower part at the middle part of the device.

In addition, the developing device 13 includes the developing roller 14 described above at a side opening at the lower part of the device. The developing device 13 includes a toner stirring member; a toner-feeding roller, which feeds a toner to the developing roller 14; and a doctor blade, which control a thickness of a toner layer on the developing roller 14 to a given thickness, at the lower part of the device, all of which are not shown in the drawing.

The intermediate transfer belt unit 3 includes an endless intermediate transfer belt (hereinafter referred simply to as a "transfer belt") 15, which extends in a flat loop shape at the center of the apparatus from an almost right end to an almost left end in the drawing; and a driving roller 16 and a driven roller 17, over which the transfer belt 15 is bridged and which circularly move the transfer belt 15 in a counterclockwise direction, as shown by an arrow "a" in the drawing.

The intermediate transfer belt unit 3 further includes tension rollers 20, which stretches the transfer belt between the driving roller 16 and the driven roller 17. The toner image is directly transferred on the belt surface of the transfer belt 15 (primary transfer), and then the resulting toner image on the belt is conveyed to a transfer position to a release sheet P in order to further transfer the toner image to the release sheet P (secondary transfer), and thus the unit as a whole is referred to as the intermediate transfer belt unit.

The intermediate transfer belt unit 3 includes a belt position control mechanism, which is not shown in the drawing, in the loop of the flat loop-shaped transfer belt 15. The belt position control mechanism includes primary transfer rollers 18 formed of an electroconductive foam sponge, which apply a pressure to a lower circumferential surface of the photoreceptor drums 8 through the transfer belt 15.

A belt cleaner 19 is disposed further upstream of the film forming unit 6*f* on the upper surface part of the intermediate transfer belt unit 3. A flat and thin waste toner recovery container, which is not shown in the drawing, is detachably disposed so as to be attached to the almost whole surface of a lower surface part of the intermediate transfer belt unit 3.

The belt cleaner 19 abuts to an upper surface of the transfer belt 15, scrapes the waste toner to remove it, and stores the waste toner in a temporary reservoir of the belt cleaner unit, which is not shown in the drawing. The stored waste toner is conveyed to the top of a dropping cylinder by a conveying screw, and then the waste toner is sent to the waste toner recovery container through the dropping cylinder.

The release sheet-feeding section 4 includes one sheet-feeding cassette 21, and a number of release sheets P are placed and stored in the sheet-feeding cassette 21. A sheet pick-up roller 22, a feeding roller 23, a separation roller 24, and a pair of standby conveying rollers 25 are disposed in the vicinity of a sheet feed port (the right side in the drawing) of the sheet-feeding cassette 21.

A secondary transfer roller 26, which is pressure-contacted with the driven roller 17 through the transfer belt 15, is disposed in a sheet-transferring direction (a vertically upward direction in the drawing) of the pair of standby conveying rollers 25, thereby forming a secondary transfer part to the release sheet.

The fixing section 5 is disposed on a downstream side (upward in the drawing) of the secondary transfer part. The fixing section 5 includes a heating roller 28 incorporating a heater 27, and a pressure roller 29 which is pressure-contacted with the heating roller 28.

A pair of sheet output rollers 32 is disposed on a further downstream side of the fixing section 5. The sheet output rollers 32 carry a toner image-fixed release sheet P from the fixing section 5, and deliver it to a sheet output tray 31 formed on the upper surface of the apparatus.

Operations of the apparatus 1 for producing a thermal transfer printing sheet are explained below. Data of a shape or printed character of the heat transfer film F of the thermal transfer printing sheet S are previously produced using a personal computer, or the like, and the data are inputted into the apparatus 1 for producing a thermal transfer printing sheet.

First, the film forming unit 6*f* positioned on the upstream side is explained. The photoreceptor drum 8 is rotated in a clockwise direction in FIG. 3, and the photoreceptor of the photoreceptor drum 8 is charged by the charging roller 11.

Next, a pattern having an arbitrary shape is exposed on the surface of the photoreceptor drum 8 by the optical writing head 12 to define non-charged parts where charges are cancelled, and latent images which are charged parts having a surface potential difference.

Then, the film-forming toner F, which is fed from the toner container 7 while being stirred, adheres to a surface of the photoreceptor drum S by rotation of the developing roller 14.

The film-forming toner F, which is charged with static electricity by the stirring, selectively adheres to the latent images on the photoreceptor drum 8 from the developing roller 14, thereby forming a developed layer as a pattern formed of the toner. The developed layer is directly transferred to the transfer belt 15 by the toner adsorption potential applied to the primary transfer roller 18 (a primary transfer). After the transfer, unnecessary film-forming toner, which adheres on the surface of the photoreceptor drum 8, is dropped by the doctor blade.

The same operations as above are performed in the three image-forming units 6*y*, 6*m* and 6*c*, and each image-forming toner having different color adheres to the transfer belt.

The toner images formed on the transfer belt 15 from the film-forming toner and each image-forming toner are conveyed to a position of the secondary transfer roller 26 by the rotation of the transfer belt 15, and are transferred to the release sheet P (secondary transfer).

Finally, the release sheet P, on which the toner images have been transferred, is passed through the fixing section 5, in which heating and pressurizing is performed by the heating roller 28 and the pressure roller 29. Thereby, the film-forming toner and each image-forming toner are melted and stuck to fix them on the release sheet P, that is, to obtain a heat transfer film F supported releasably by the release sheet P. The thermal transfer printing sheet S is produced as described above.

The heat transfer film F on which the toner has been fixed has a layer thickness of generally 15 μm or more, typically 15 to 50 μm, preferably 20 to 40 μm. In the explanation described above, a secondary transfer system is adopted, but it is also possible to adopt another transfer system such as a primary transfer system so long as the heat transfer film F having the above-mentioned layer thickness (transfer amount) is obtained.

5. Process of Producing Thermal Transfer Printing Sheet and Thermal Transfer Printing Process A process of producing the thermal transfer printing sheet, which is performed using the above-mentioned apparatus for producing the thermal transfer printing sheet, and a thermal transfer printing process using the obtained thermal transfer printing sheet are explained referring to FIG. 4.

Figure 4:
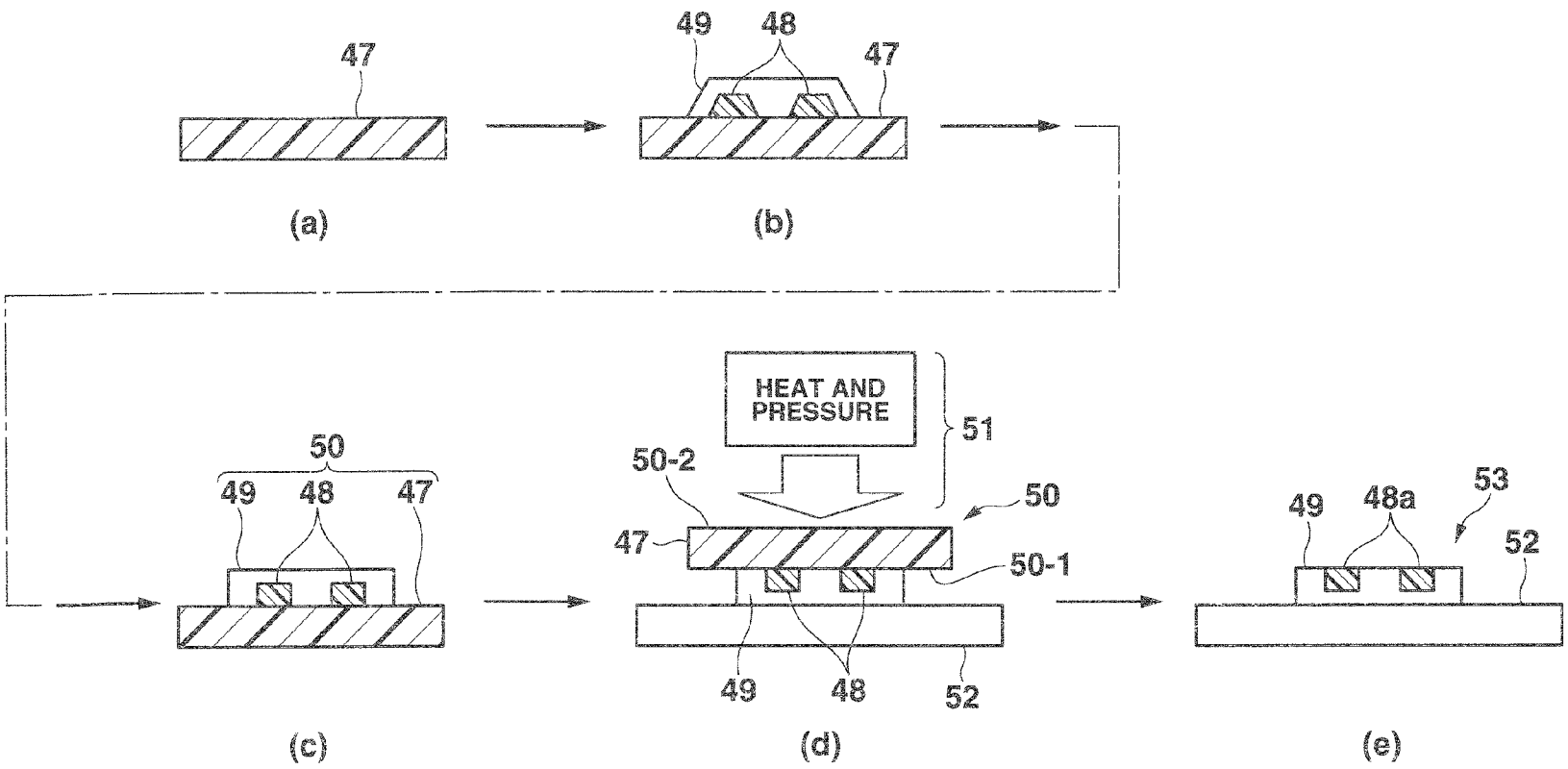
FIG. 4 is a view schematically showing a process of producing a thermal transfer printing sheet according to one embodiment of the present invention, and a process of transferring a printed image of the thermal transfer printing sheet to a transfer object, wherein (a) to (c) schematically show the production process described above, and (d) and (e) schematically show the transferring process described above.

In FIG. 4, (a) to (c) show schematically a process of producing the thermal transfer printing sheet according to the present embodiment, and (d) and (e) show schematically a process of transferring the printed images on the thermal transfer printing sheet to a transfer object.

In FIG. 4, (a) shows a first step. The step (a) shows a transparent release sheet 47, which is sent from the sheet-feeding cassette 21 shown in FIG. 3 (the sheet is hatched in order to distinguish it from a film-shaped toner layer 49 appearing in the following step).

In FIG. 4, (b) shows a second step. The step (b) shows a state where toner images (mirror images 48), which are to be transferred to a transfer object, and a film-shaped toner layer 49 are transferred to a release surface of the release sheet 47 by the transfer belt 15 shown in FIG.

In FIG. 4, (c) shows a third step. The step (c) shows a state where the release sheet 47 obtained in the second step is carried in the fixing section 5 shown in FIG. 3, and the toner images (the mirror images 48) and the film-shaped toner layer 49 are fixed by heating and pressurizing.

By the process from the first step to the third step, the production of the thermal transfer printing sheet 50 including the release sheet 47, the mirror images 48, and the film-shaped toner layer 49 is completed.

Subsequently, in FIG. 4, (d) shows a fourth step. In the step (d), the thermal transfer printing sheet 50 is superimposed on a transfer object 52 such as a T-shirt so that a mirror image-formed surface (a release surface) 50-1 can face the transfer object 52, by using, for example, a heating press 51 sold for industrial use.

Then, heat and pressure are applied from a back surface 50-2 opposite to the mirror image-formed surface of the thermal transfer printing sheet 50. Thereby, the thermal transfer printing sheet 50 is adhered to the transfer object 52 with the film-shaped toner layer 49 interposed therebetween so that the release sheet 47 can be detached after cooling.

In the embodiment described above, the heating press 51 is used, but the heating press 51 is a large machine and expensive, and thus the thermal transfer printing sheet 50 may be adhered to the transfer object 52 by manually ironing.

After that, when the thermal transfer printing sheet 50 is cooled to about room temperature, the release sheet 47 is manually detached. As a result, the transfer printing of the heat transfer film 53, which has been changed from the mirror image 48 to normal images 48*a*, is completely formed on the transfer object 52, which is an object to be printed such as a T-shirt, as shown in a step (e) of FIG. 4.

EXAMPLES

Examples of the present invention are shown below, and effects of the present invention are specifically described.

Example 1-1

Production of Toner for Thermal Transfer Printing Sheet

As a crystalline polyester resin, 100 parts by mass of VYLON "GM-990" (TOYOBO Co., Ltd.) was freeze-pulverized in Linrex Mill "LX-0" (Hosokawa Micron Corporation) under liquid nitrogen. The obtained pulverized product was classified through a sieve (a diameter of an opening: 53 μm) to obtain only a product which passed through the 53 μm filter, whereby toner particles 1-1 were prepared. The prepared toner particles 1-1 had an average particle size D50 (volume) of 44 μm.

<Evaluation Method and Evaluation Criteria>

(1) Grindability

A freeze-pulverized product obtained using 100 g of a crystalline polyester resin was classified through a sieve (a diameter of an opening: 53 μm) over 60 seconds. The grindability was evaluated as to whether or not the amount of the classified product, which passed through the sieve, was more than 5 g.

○: More than 5 g of the classified product, which passed through the sieve.

x: 5 g or less of the classified product, which passed through the sieve.

(2) Chargeability

The obtained toner particles 1-1 were measured using a flight-type charge amount measuring apparatus (DIT Co., Ltd.). Specifically, a measurement sample and a carrier (F-100) (a concentration of 1%) were stirred in a ball mill at 100 rpm for 12 hours, a flying rate was measured at −1 kV or 1 kV, and chargeability was evaluated by ±.

(3) Fixing Property

The obtained toner particles 1-1 were thinly and uniformly spread on a release paper, and then it was passed through a fixing device obtained by remodeling a printer "GE5000" manufactured by Casio Computer Co., Ltd. so that only a fixing device could operate, at a post card mode setting, thereby preparing a sheet for evaluation. The fixing property of the toner layer (the sheet-shaped film) to the release paper was observed.

○: The toner layer is fixed on the release paper as the sheet-shaped film.

x: The toner layer is not fixed on the release paper (for example, by winding the toner layer around the fixing device).

(4) Deformation Upon Cooling

When the above-mentioned sheet for evaluation was cooled to room temperature, it was observed whether or not the toner layer (the sheet-shaped film) was deformed.

○: The toner layer remains on the release paper and no deformation is observed.

Δ: A slight deformation such as curling is observed.

x: A large deformation is observed, or the toner layer is peeled off.

The sheet having an evaluation of Δ had no problems to use it as the thermal transfer printing sheet.

(5) Surface Tackiness after One Day

The above-mentioned sheet for evaluation was allowed to stand for one day, and then it was observed whether or not the tackiness remained on the surface by rubbing the surface with fingers.

○: No tacky x: Tacky

It was difficult to use the tacky sheet as the thermal transfer printing sheet.

(6) Printing Toner-Holding Property

The above-mentioned sheet for evaluation was pasted to a paper sheet, printing was performed on the toner layer (the sheet-shaped film) with the printing toner, and the printed toner was lightly rubbed with a nail. At that time, it was observed whether or not the printed toner was peeled off.

○: The printed toner is not peeled off even if it is rubbed.

x: The printed toner is peeled off from the sheet surface, or peeled off when it is rubbed.

(7) Softening Temperature

A flow tester "CFT-500D" (manufactured by Shimadzu Corporation) was used for the measurement of the softening point. Measurement of 1 g of a sample was performed at a temperature rising rate of 6° C./minute with a load of 20 kg using a nozzle having a diameter of 1 mm and a length of 1 mm. A temperature at which a half of the sample flowed out according to a ½ method was defined as a softening point.

(8) Grass Transition Temperature (Tg)

A differential scanning calorimeter "DSC6220" (manufactured by SII Nano Technology Inc.) was used for the measurement of the grass transition point (Tg). The sample was heated to 150° C. at a temperature rising rate of 10° C./minute, cooled to −70° C. at a temperature cooling rate of 10° C./minute, and heated again to 150° C. at a temperature rising rate of 10° C./minute. An intersection point of two lines tangent to a curved line part obtained by transition at the second temperature rising was defined as a grass transition point.

Example 1-2

Toner particles and a sheet for evaluation were prepared in the same manner as in Example 1-1, except that 100 parts by mass of POLYESTER "SP154" (Nippon Synthetic Chemical Industry Co., Ltd.) was used as the crystalline polyester resin. The obtained toner particles had an average particle size D50 (volume) of 47 μm.

Example 1-3

Toner particles and a sheet for evaluation were prepared in the same manner as in Example 1-1, except that 100 parts by mass of POLYESTER "SP176" (Nippon Synthetic Chemical Industry Co., Ltd.) was used as the crystalline polyester resin. The obtained toner particles had an average particle size 050 (volume) of 46 μm.

Example 1-4

Toner particles and a sheet for evaluation were prepared in the same manner as in Example 1-1, except that 100 parts by mass of "PES-120L" (TOAGOSEI Co., Ltd.) was used as the crystalline polyester resin. The obtained toner particles had an average particle size D50 (volume) of 41 μm.

Example 1-5

Toner particles and a sheet for evaluation were prepared in the same manner as in Example 1-1, except that 100 parts by mass of Elitel "UE3200G" (UNITIKA Ltd.) was used as the crystalline polyester resin. The obtained toner particles had an average particle size D50 (volume) of 47 μm.

Comparative Example 1-1

Toner particles and a sheet for evaluation were prepared in the same manner as in Example 1-1, except that 100 parts by mass of "FZ91PD" (Mitsubishi Chemical Corporation) was used as a polybutylene succinate resin. The obtained toner particles had an average particle size D50 (volume) of 48 μm.

Comparative Example 1-2

Toner particles and a sheet for evaluation were prepared in the same manner as in Example 1-1, except that 100 parts by mass of ULTZEX "1020L" (Prime Polymer Co., Ltd.) was used as the polyethylene resin. The obtained toner particles had an average particle size D50 (volume) of 46 μm.

Comparative Example 1-3

Toner particles and a sheet for evaluation were prepared in the same manner as in Example 1-1, except that 100 parts by mass of Sumikathene "F412-1" (Sumitomo Chemical Co., Ltd.) was used as the polyethylene resin. The obtained toner particles had an average particle size D50 (volume) of 39 μm.

Comparative Example 1-4

Toner particles and a sheet for evaluation were prepared in the same manner as in Example 1-1, except that 100 parts by mass of Prime Polypro "F329RA" (Prime Polymer Co., Ltd.) was used as a polypropylene resin. The obtained toner particles had an average particle size D50 (volume) of 47 μm.

Comparative Example 1-5

Toner particles and a sheet for evaluation were prepared in the same manner as in Example 1-1, except that 100 parts by mass of WINTEC "WFX4" (Japan Polypropylene Corporation) was used as the polypropylene resin. The obtained toner particles had an average particle size D50 (volume) of 46 μm.

[Results]

Evaluation results are shown in Table 1. In Table 1, blanks in a Tg column shows that the measurement could not be performed in the measurement conditions described in the instant specification.

TABLE 1

| | Main resin material | Trade name | Grind-ability | Charge-ability | Fixing property | Deformation upon cooling | Surface tackiness after one day | Printing toner-holding property | Softening temperature (° C.) | Tg (° C.) |
|---|---|---|---|---|---|---|---|---|---|---|
| Example 1-1 | Crystalline polyester | GM990 | ○ | (−) | ○ | ○ | ○ | ○ | 132 | 4 |
| Example 1-2 | Crystalline polyester | SP154 | ○ | (−) | ○ | ○ | ○ | ○ | 130 | −20 |
| Example 1-3 | Crystalline polyester | SP176 | ○ | (−) | ○ | ○ | ○ | ○ | 143 | 0 |
| Example 1-4 | Crystalline polyester | PES-120L | ○ | (−) | ○ | ○ | ○ | ○ | 122 | −10 |
| Example 1-5 | Crystalline polyester | UE3200G | ○ | (−) | ○ | Δ | ○ | ○ | 141 | 65 |
| Comparative Example 1-1 | Polybutylene succinate | FZ91PD | ○ | (+) | x | x | ○ | ○ | 127 | −22 |
| Comparative Example 1-2 | Polyethylene | 1020L | x | (−) | x | Δ | ○ | x | 134 | |
| Comparative Example 1-3 | Polyethylene | F412-1 | ○ | (−) | x | x | ○ | x | 130 | |
| Comparative Example 1-4 | Polypropylene | F329RA | x | 0 | x | x | ○ | x | 157 | |
| Comparative Example 1-5 | Polypropylene | WFX4 | x | (−) | x | x | ○ | x | 145 | |

As shown in Table 1, the film-forming toners obtained using the crystalline polyester as the resin material showed the excellent characteristics in all of the evaluation items of the grindability, the chargeability, the fixing property to a release paper, the deformation upon cooling, the surface tackiness after one day, and the printing toner-holding property (Examples 1-1 to 1-5).

On the other hand, the film-forming toner obtained using the polybutylene succinate resin "FZ91PD" showed a positive charge, and the toner layer was not be fixed on the release paper, and the deformation of the toner layer was observed at cooling (Comparative Example 1-1).

In the film-forming toner obtained using the polyethylene resin "1020L", the grindability was poor, the toner layer was not fixed on the release paper, and the printing toner-holding property was not good (Comparative Example 1-2).

In the film-forming toner obtained using the polyethylene resin "F412-1", the toner layer was not fixed on the release paper, the deformation of the toner layer was observed at cooling, and the printing toner-holding property was not good (Comparative Example 1-3).

In the film-forming toner obtained using the polypropylene resin "F329RA", the grindability was poor, the charge was 0, the toner layer was not fixed on the release paper, the deformation of the toner layer was observed at cooling, and the printing toner-holding property was not good (Comparative Example 1-4).

In the film-forming toner obtained using the polypropylene resin "WFX4", the grindability was poor, the toner layer was not fixed on the release paper, the deformation of the toner layer was observed at cooling, and the printing toner-holding property was not good (Comparative Example 1-5).

Examples 2-1 to 2-3

In Examples 2-1 to 2-3, the effects of the thickness of the above-mentioned sheet for evaluation obtained in Example 1-1 on the deformation and the launderability were examined. A sheet for evaluation was prepared in the same manner as in Example 1-1 so that the toner layer (the sheet-shaped film) had a thickness of 15 μm, 20 μm, or 30 μm.

At the stage when the sheet was obtained, it was evaluated whether or not the deformation was observed on the toner layer (the sheet-shaped film).

○: Deformation is not observed.

x: Deformation is observed.

The launderability was evaluated as follows. The toner layer of the sheet for evaluation (the film on the sheet) was transferred to a 100% cotton cloth at 180° C. for 10 seconds by applying heat and pressure to the sheet for evaluation, whereby the film was transferred to the cloth. The obtained cloth was washed in a washing machine at a standard course, and the resulting cloth was dried in the sun. A cycle of the washing and the drying was repeated 5 times, and the launderability was evaluated.

○: The film is not peeled off from the cloth even after the washing and drying was repeated 5 times.

x: A part of the film is peeled off from the cloth after the washing and drying is repeated 5 times.

The results are shown in Table 2,

TABLE 2

| | Thickness | Deformation | Launderability |
|---|---|---|---|
| Example 2-1 | 15 μm | ○ | ○ |
| Example 2-2 | 20 μm | ○ | ○ |
| Example 2-3 | 30 μm | ○ | ○ |

In all of the cases where the toner layer had a thickness of 15 μm, 20 μm, or 30 μm, the deformation was not observed on the toner layer.

As for the launderability, in all of the cases where the toner layer had a thickness of 15 μm, 20 μm, or 30 μm, the film transferred on the cloth had a strength capable of standing friction stresses applied during the washing and the spin-drying. Even if the film-forming toner and the printing toner for forming images were printed simultaneously, it is possible to show the above launderability due to the characteristic of the film resin contained in the film-forming toner, because the amount of the printing toner is extremely small compared to the necessary amount of the film-forming toner.

Example 3-1

In Example 3-1, the addition effect of fluororesin fine particles was examined.

<Preparation of Toner for Thermal Transfer Printing Sheet>

As toner raw materials, 100 parts by mass of a crystalline polyester resin VYLON "GM-990" (TOYOBO Co., Ltd.) and 1 part by mass of fluororesin fine particles "KTL-500F" (KITAMURA Limited) were used. The fluororesin fine particles "KTL-500F" has a heat-resistance of 400° C., and does not receive the influence of heat during the preparation of the toner, printing, and heat-transfer. The above-mentioned toner raw materials were mixed, the mixture was melt-kneaded through a twin-screw extruder, the obtained melt-kneaded product was finely cut and pelletized, and the resulting pellets were freeze-pulverized under liquid nitrogen in Rinrex Mill "LX-0" (Hosokawa Micron Corporation). The obtained pulverized products were classified through a sieve (a diameter of an opening: 53 μm) to obtain toner base particles. To 100 parts by mass of the toner base particles was added 1 part by mass of hydrophobic silica "R972" (Nippon Aerosil Co., Ltd.), and the mixture was stirred in a Henschel mixer to obtain toner particles 3-1. The obtained toner had an average particle size D50 (volume) of 35 μm.

<Evaluation Method and Evaluation Citeria>

(1) Strength Against Rubbing

The obtained toner was filled in a toner cartridge in a printer "GE5000" manufactured by Casio Computer Co., Ltd. (see FIG. 3), and printing was performed. A strength against slight rubbing in the inside of the printer was evaluated during the printing.

○: No change on the surface by rubbing against a rib is observed.

Δ: Slight traces rubbed are observed, but there are no practical problems.

x: Peeling off and occurrence of loss by rubbing are observed, and there are practical problems.

(2) Electrification (Fogging)

The presence or absence of fogging (i.e., toner developed on a non-printed part) was confirmed on a drum by stopping the printing during the printing.

In addition, a fog amount was obtained by the following fog measurement method. Using a Scotch mending tape (18 mm) manufactured by Sumitomo 3M Limited, a non-printed part is subjected to tape peeling before the primary transfer and after the development. A fog amount per area was calculated from a contact area and a weight.

○: No powder can be observed. The fog amount is 0.05 $mg/cm^2$ or less.

Δ: Although a powder can be observed slightly, there are no practical problems. The fog amount is more than 0.05 $mg/cm^2$ and 0.15 $mg/cm^2$ or less.

x: A powder can be clearly observed, and there are practical problems. The fog amount is more than 0.15 $mg/cm^2$.

(3) Particle Size of Toner

The measurement of a particle size of toner was performed using "FPIA-2100" manufactured by Sysmex Corporation. Here, a small amount of a sample was put in a beaker together with purified water and a surfactant, the mixture was dispersed by using an ultrasonic cleaning machine, and the obtained dispersion was used for the measurement. The measurement was performed at an aperture of 100 μm and a count of 50000 to obtain a volume average particle size (D50).

Example 3-2

In Example 3-2, toner particles were obtained in the same manner as in Example 3-1, except that the addition amount of the fluororesin fine particles "KTL-500F" was changed to 3 parts by mass based on 100 parts by mass of the crystalline polyester resin. The obtained toner particles had an average particle size D50 (volume) of 35 μm.

Example 3-3

In Example 3-3, toner particles were obtained in the same manner as in Example 3-1, except that the addition amount of the fluororesin fine particles "KTL-500F" was changed to 5 parts by mass based on 100 parts by mass of the crystalline polyester resin. The obtained toner particles had an average particle size D50 (volume) of 35 μm.

Example 3-4

In Example 3-4, toner particles were obtained in the same manner as in Example 3-1, except that the addition amount of the fluororesin fine particles "KTL-500F" was changed to 7 parts by mass based on 100 parts by mass of the crystalline polyester resin. The obtained toner particles had an average particle size D50 (volume) of 37 μm.

Example 3-5

In Example 3-5, toner particles were obtained in the same manner as in Example 3-1, except that the fluororesin fine particles were not added. Specifically, 1 part by mass of hydrophobic silica "R972" (Nippon Aerosil Co., Ltd.) was added to the toner particles 1-1 (100 parts by mass) obtained in Example 1-1, and the mixture was stirred in a Henschel mixer to produce toner particles. The obtained toner had an average particle size D50 (volume) 45 μm.

Example 3-6

In Example 3-6, toner particles were obtained in the same manner as in Example 3-1, except that a charge control agent "LR-147" (Japan Carlit Co., Ltd.) was used instead of the fluororesin fine particles in an amount of 1 part by mass based on 100 parts by mass of the crystalline polyester resin. The obtained toner particles had an average particle size D50 (volume) of 41 μm.

Example 3-7

In Example 3-7, toner particles were obtained in the same manner as in Example 3-1, except that a charge control agent "E-304" (Orient Chemical Industries Co., Ltd.) was used instead of the fluororesin fine particles in an amount of 1 part by mass based on 100 parts by mass of the crystalline polyester resin. The obtained toner particles had an average particle size D50 (volume) of 40 μm.

Example 3-8

In Example 3-8, toner particles were obtained in the same manner as in Example 3-1, except that a charge control agent "FCA-2521NJ" (Fujikura Kasei Co., Ltd.) was used instead of the fluororesin fine particles in an amount of 1 part by mass based on 100 parts by mass of the crystalline polyester resin. The obtained toner particles had an average particle size D50 (volume) of 40 μm.

[Results]

Evaluation results are shown in Table 3.

TABLE 3

| | Charge control agent (Trade name) | Blending ratio (%) | Strength against rubbing | Electrification (Fogging) | Particle size (μm) |
|---|---|---|---|---|---|
| Example 3-1 | KTL-500F | 1 | ○ | ○ | 35 |
| Example 3-2 | KTL-500F | 3 | ○ | ○ | 35 |
| Example 3-3 | KTL-500F | 5 | ○ | ○ | 35 |
| Example 3-4 | KTL-500F | 7 | ○ | ○ | 37 |
| Example 3-5 | Not added | 0 | Δ | Δ | 45 |
| Example 3-6 | LR-147 | 1 | Δ | Δ | 41 |
| Example 3-7 | E-304 | 1 | Δ | Δ | 40 |
| Example 3-8 | FCA2521NJ | 1 | Δ | Δ | 40 |

As shown in Table 3, when the fluororesin fine particles were added to the film-forming toner containing the crystalline polyester resin as a main rein, the strength against rubbing could be more improved, and the fogging property could be more improved due to the improved chargeability (Examples 3-1 to 3-4), as compared to the case where the fluororesin fine particles are not added.

When the charge control agents other than the fluororesin fine particles were added to the film-forming toner containing the crystalline polyester resin as a main resin, the above-mentioned effects were not obtained (Examples 3-6 to 3-8).

It is important to improve the strength against rubbing in the film-forming toner from the following points. After the fixing, the toner layer is brought into contact with rollers or ribs in a printer frequently. Multiple sheets are overlapped and brought into contact with each other, when ejected into an output tray in a printer. The toner layer can secure its thickness due to the large particle size of the film-forming toner, but the frequency of contact is increased by the thickness. The crystalline polyester does not deform after the fixing, but it is tacky, soft, and poor in slip, because the crystallinity does not stabilize for a while after melting until it is cooled.

Further, it is important to improve the fogging property due to the improved chargeability in the film-forming toner from the following points. The film-forming toner has a large particle size, and thus it is hard to provide the film-forming toner with the chargeability, which plays an important role on the development performance.

Example 4-1

In Example 4-1, the addition effect of Fischer-Tropsch wax was examined.

<Preparation of Toner for Thermal Transfer Printing Sheet>

As toner raw materials, 100 parts by mass of crystalline polyester resin VYLON "GM-990" (TOYOBO Co., Ltd.) and 2 parts by mass of Fischer-Tropsch wax "FNP-0090" (NIPPON SEIRO Co., Ltd.) were used. The toner raw materials were mixed, the mixture was melt-kneaded through a twin-screw extruder, the obtained melt-kneaded product was finely cut and pelletized, and the resulting pellets were freeze-pulverized under liquid nitrogen in Linrex Mill "LX-0" (Hosokawa Micron Corporation). The obtained pulverized products were classified through a sieve (a diameter of an opening: 53 μm) to obtain toner particles 4-1. The obtained toner had an average particle size D50 (volume) of 33 μm.

<Evaluation Method and Evaluation Criteria>

(1) Kneading Property

In the melt-kneading, it was observed whether or not the wax was dispersed without uneven distribution or bleeding in the twin-screw extruder.

○: Wax bleeding is not observed.

Δ: The melted state is slightly disturbed at the exit.

x: Wax bleeding is observed.

(2) Fixing Property

The fixing property was evaluated as follows. The toner layer having a thickness of 20 μm was put on the release paper, and a line speed of 34.1 mm/second in an OHP mode was defined as a standard. A low-temperature offset property was confirmed by increasing the line speed, and a high-temperature offset property was confirmed by decreasing the line speed.

○: The sheet is uniformly fixed on the release paper.

Δ: The sheet is peeling off from the release paper in a small area, but there are no practical problems.

x: Defects are observed on the sheet, and there are practical problems.

Example 4-2

In Example 4-2, toner particles were obtained in the same manner as in Example 4-1, except that the addition amount of Fischer-Tropsch wax "FNP-0090" was changed to 3 parts by mass based on 100 parts by mass of the crystalline polyester resin. The obtained toner particles had an average particle size D50 (volume) of 33 μm.

Example 4-3

In Example 4-3, toner particles were obtained in the same manner as in Example 4-1, except that the addition amount of Fischer-Tropsch wax "FNP-0090" was changed to 3.5 parts by mass based on 100 parts by mass of the crystalline polyester resin. The obtained toner particles had an average particle size D50 (volume) of 33 μm.

Example 4-4

In Example 4-4, toner particles were obtained in the same manner as in Example 4-1, except that the addition amount of Fischer-Tropsch wax "FNP-0090" was changed to 4 parts by mass based on 100 parts by mass of the crystalline polyester resin. The obtained toner particles had an average particle size D50 (volume) of 35 μm.

Example 4-5

In Example 4-5, toner particles were obtained in the same manner as in Example 4-1, except that Fischer-Tropsch wax "SX 105" (NIPPON SEIRO Co., Ltd.) was used instead of Fischer-Tropsch wax "FNP-0090" in an amount of 3 parts by mass based on 100 parts by mass of the crystalline polyester resin. The obtained toner particles had an average particle size D50 (volume) of 37 μm.

Example 4-6

In Example 4-6, toner particles were obtained in the same manner as in Example 4-1, except that Fischer-Tropsch wax "H1N4" (Sasol Wax GmbH) was used instead of Fischer-Tropsch wax "FNP-0090" in an amount of 3 parts by mass based on 100 parts by mass of the crystalline polyester resin. The obtained toner particles had an average particle size D50 (volume) of 35 μm.

Example 4-7

In Example 4-7, toner particles were obtained in the same manner as in Example 4-1, except that "carnauba wax No. 1" (S. Kato & Co.) was used instead of Fischer-Tropsch wax "FNP-0090" in an amount of 3 parts by mass based on 100 parts by mass of the crystalline polyester resin. The obtained toner particles had an average particle size D50 (volume) of 35 μm.

Example 4-8

In Example 4-8, toner particles were obtained in the same manner as in Example 4-1, except that "NP056" (Mitsui Chemicals. Inc.) was used instead of Fischer-Tropsch wax "FNP-0090" in an amount of 3 parts by mass based on 100 parts by mass of the crystalline polyester resin. The obtained toner particles had an average particle size D50 (volume) of 35 μm.

Example 4-9

In Example 4-9, toner particles were obtained in the same manner as in Example 4-1, except that Fischer-Tropsch wax was not added. The obtained toner had an average particle size D50 (volume) of 35 μm.

[Results]

Evaluation Results are shown in Table 4.

TABLE 4

| | Wax (Trade name) | Melting point (° C.) | Blending ratio (%) | Kneading property | Line speed x2 | Line speed x1.5 | Line speed x1 | Line speed x0.5 | Particle size (μm) |
|---|---|---|---|---|---|---|---|---|---|
| Example 4-1 | FNP-0090 | 90 | 2 | ○ | Δ | ○ | ○ | ○ | 33 |
| Example 4-2 | FNP-0090 | 90 | 3 | ○ | ○ | ○ | ○ | ○ | 33 |

TABLE 4-continued

| | Wax (Trade name) | Melting point (° C.) | Blending ratio (%) | Kneading property | Line speed x2 | Line speed x1.5 | Line speed x1 | Line speed x0.5 | Particle size (μm) |
|---|---|---|---|---|---|---|---|---|---|
| Example 4-3 | FNP-0090 | 90 | 3.5 | ○ | ○ | ○ | ○ | ○ | 33 |
| Example 4-4 | FNP-0090 | 90 | 4 | Δ | ○ | ○ | ○ | ○ | 35 |
| Example 4-5 | SX105 | 96, 115 | 3 | ○ | Δ | ○ | ○ | ○ | 37 |
| Example 4-6 | H1N4 | 80, 104 | 3 | ○ | Δ | ○ | ○ | ○ | 35 |
| Example 4-7 | Carnauba No. 1 | 82 | 3 | ○ | x | x | ○ | ○ | 35 |
| Example 4-8 | NP506 | 124, 134 | 3 | Δ | x | x | ○ | ○ | 35 |
| Example 4-9 | Not added | — | 0 | ○ | x | x | ○ | ○ | 35 |

As shown in Table 4, when Fischer-Tropsch wax was added to the film-forming toner containing the crystalline polyester resin as a main resin, the fixing effect at the high line speed, i.e., the low-temperature fixing effect was obtained in addition to the fixing effect at the standard line speed (Examples 4-1 to 4-6). When Fischer-Tropsch wax was not added, the fixing effect at the standard line speed was obtained, but the fixing effect at the high line speed was not obtained (Example 4-9). In Examples 4-7 and 4-8 wherein the wax other than Fischer-Tropsch wax was added, the fixing effect at the standard line speed was obtained, but the fixing effect at the high line speed was not obtained. However, the low-temperature fixing effect is a desirable effect of the film-forming toner, and if the toner has the fixing effect at the standard line speed, there are no practical problems.

What is claimed is:

1. A method for producing a toner for a thermal transfer printing sheet, the method comprising freeze-pulverizing a raw material containing a negative-charged crystalline polyester resin, wherein the raw material is freeze-pulverized so that a pulverized product has an average particle size D50 (volume) of 20 to 50 μm.

2. A thermal transfer printing sheet comprising:

a release sheet having a release surface; and a film pattern releasably supported on the release surface, wherein the film pattern comprises (i) a color toner layer which forms a printed image, and (ii) a film-shaped toner layer which is formed from a toner containing a negative-charged crystalline polyester resin and having an average particle size D50 (volume) of 20 to 50 μm, wherein the film-shaped toner layer is at least partially overlapped with the printed image.

3. A method for producing a thermal transfer printing sheet, comprising:

forming a film pattern releasably supported on a release surface of a release sheet, wherein the film pattern comprises (i) a color toner layer which forms a printed image, and (ii) a film-shaped toner layer which is formed from a toner containing a negative-charged crystalline polyester resin and having an average particle size D50 (volume) of 20 to 50 μm, wherein the film-shaped toner layer is at least partially overlapped with the printed image; and fixing the film pattern by heat and pressure into a film.

* * * * *